US009370250B2

(12) United States Patent
Ead

(10) Patent No.: US 9,370,250 B2
(45) Date of Patent: Jun. 21, 2016

(54) HOSPITAL BED FOR AUTOMATICALLY CHANGING SHEETS

(71) Applicant: Ultimate Comfort n Care Products LLC, Providence, RI (US)

(72) Inventor: Nimer Mohammed Ead, Providence, RI (US)

(73) Assignee: Ultimate Comfort N Care Products LLC, Providence, RI (US)

( * ) Notice: Subject to any disclaimer, the term of this patent is extended or adjusted under 35 U.S.C. 154(b) by 292 days.

(21) Appl. No.: 14/213,785

(22) Filed: Mar. 14, 2014

(65) Prior Publication Data

US 2014/0259435 A1 Sep. 18, 2014

Related U.S. Application Data

(60) Provisional application No. 61/784,948, filed on Mar. 14, 2013.

(51) Int. Cl.

| | |
|---|---|
| ***A47C 27/08*** | (2006.01) |
| ***A47C 21/02*** | (2006.01) |
| ***A61G 7/057*** | (2006.01) |
| ***A61G 7/05*** | (2006.01) |

(52) U.S. Cl.

CPC ..... *A47C 21/028* (2013.01); *A47C 27/083* (2013.01); *A61G 7/0502* (2013.01); *A61G 7/057* (2013.01); *A61G 7/0573* (2013.01); *A61G 7/05769* (2013.01)

(58) Field of Classification Search

CPC .. A47C 21/028; A47C 27/083; A61G 7/0573; A61G 7/057; A61G 7/05769; A61G 7/0502

See application file for complete search history.

(56) References Cited

U.S. PATENT DOCUMENTS

| | | | | |
|---|---|---|---|---|
| 6,006,378 | A | 12/1999 | Hayashi | |
| 6,594,837 | B2 | 7/2003 | Khait | |
| 7,191,479 | B1 * | 3/2007 | Cheng | A47C 21/028 5/488 |
| 7,895,688 | B1 * | 3/2011 | Rowes | A61G 7/001 5/607 |
| 8,719,980 | B2 * | 5/2014 | Chen | A61G 7/0573 297/311 |
| 2011/0072582 | A1 * | 3/2011 | Patterson | A61F 13/15 5/484 |
| 2011/0214233 | A1 * | 9/2011 | Stang | A47C 21/028 5/488 |
| 2012/0159709 | A1 * | 6/2012 | Nguyen | A47C 21/028 5/488 |
| 2013/0291309 | A1 * | 11/2013 | Koorey | A47C 19/045 5/658 |

* cited by examiner

*Primary Examiner* — David E Sosnowski

(74) *Attorney, Agent, or Firm* — Knobbe, Martens, Olson & Bear LLP

(57) ABSTRACT

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bedsheets while the hospital bed is occupied by a patient. The present invention also comprises of a medical bed apparatus which allows the seamlessly changing of a used bed sheet with a new bed sheet while the bed is occupied by a person, and a method thereof. Optionally, the medical or hospital bed can also have an air bladder system to inflate or deflate the hospital bed mattress while a bed sheet is being changed.

5 Claims, 11 Drawing Sheets

HOSPITAL BED FOR AUTOMATICALLY CHANGING SHEETS

CROSS-REFERENCE TO RELATED APPLICATION

The instant patent application claims priority to and the benefit of U.S. Provisional Patent Application Ser. No. 61/784,948, filed on Mar. 14, 2013, titled "MALIX BED, AND A BED APPARATUS CAPABLE OF SEAMLESSLY CHANGING BED-SHEETS WHILE OCCUPIED BY AN IMMOBILE PERSON, AND A METHOD THEREOF", the entire disclosure of which provisional application is incorporated herein by reference.

FIELD OF THE INVENTION

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bed-sheets while the hospital bed is occupied by a patient. The present invention also comprises of a medical bed apparatus which allows the seamlessly changing of a used bed sheet with a new bed sheet while the bed is occupied by a person, and a method thereof. Optionally, the medical or hospital bed can also have an air bladder system to inflate or deflate the hospital bed mattress while a bed sheet is being changed.

BACKGROUND INFORMATION

Hospital beds have been known and have been used for many years, and under a variety of applications.

Existing hospital beds, including various kinds of hospital beds, the patient must be moved before changing bed sheets. In many cases the disabled or some patients cannot leave the bed without the help of others. This is a hardship for patient family members and the nurses, and more importantly, it may cause pain and discomfort to the patients. For those who are injured in the cervical vertebra or the vertebra, suffering from various kinds of serious injuries, or a patient recovering from a surgery, it often causes secondary injury if the patient is moved, and this also further hinders patient recovery.

Changing bed linens in a hospital or healthcare facility is necessary and advantageous. It allows the hospital staff and patients to promote cleanliness and prevents unnecessary infections, ulcers, injuries, or losing expensive hard-to-replace items. Changing the bed linen while the patient is still on the hospital bed carries significant challenges, both for the patient, and the caregiver. Multiple steps need to be taken to make the task possible. However, these steps are not without drawbacks and limitations, for example:

(1) Making arrangements for assistance: Assistance is required whether one is at a hospital, a skilled nursing facility, or at home. If one is at the home, then one would need a friend or a family member who would be willing to help out;

(2) Scheduling helpers: Learning how to provide the care needed without straining ones back or otherwise injuring oneself is not only important but it is very challenging too;

(3) Positioning the bed: The quality of the bed and adjustability are very crucial, trying to work with a non-adjustable medical bed is not practical, as it will make bedside care extremely difficult. Further it requires more people and this creates a crowded area around the bed, which restricts maneuverability, such as, having two to four people doing the task;

(4) Raising and lowering the ends of the bed: For example, when patients have congestive heart failure or respiratory disease, a hospital bed's ability to raise the head of the bed up will greatly help the patient to breathe more easily, moving the patient out of the bed or rolling him on either side or lifting him up;

(5) Side rails and safety: Side rails and safety are extremely important to have if the patient is confused or may become confused in the future, and this also prevents a patient from falling out of the medical bed;

(6) Keeping linens flat and smooth: Wrinkles in the bed, or the bed sheet, or any debris will irritate the skin and cause discomfort as well as injury to the skin. Some patients become so sensitive that they cannot tolerate anything at all lying on top of their feet, even a bed sheet;

(7) Need to reposition patient up in bed: If assistance is not provided, the patient remains slumped down too far toward the foot of the bed and will not only feel uncomfortable, but the position can interfere with ease in breathing and also cause unnecessary pressure on the base of the spline and result in skin breakdown;

(8) Need to avoid dragging: When a patient experiences difficulty turning him or pulling him up in bed, pulling or pushing him without lifting will result in dragging his body across the bed. Dragging him from side to side or up in bed can cause injury to the skin;

(9) Draw bed sheets used to lift or turn: Draw bed sheets used to lift or turn has been widely used to help changing the bed sheet. However, it needs high level of training and it is not without pain and discomfort;

(10) Turning the patient: In hospitals, it is a standard procedure to turn or roll a patient in bed every two hours to avoid skin breakdown and bedsores from developing, as these complication is associated with significant distress to both patient and caregiver and they are extremely difficult to treat when they occur. However, in some cases, at the very end, it will not be appropriate to turn the patient in bed, because this could be more disturbing or painful at the time;

(11) Changing the bed sheets: Changing the bed sheets job is very difficult, especially for the immobilized or paralyzed patient, and it needs a lot of patience and nursing technique. However, changing the bed sheets on a regular basis is extremely important not only because it can help patient feeling more comfortable; but also keeping clean and dry are part of preventing infection, skin breakdown, or bedsores, from happening;

(12) Dealing with urinary Incontinence and bowel Incontinence: If urinary and bowel incontinence are occurring on a regular basis, one will need to place incontinent pads underneath the patient. These can be reusable and washable (made of cloth) or disposable. One will also need to place incontinent briefs to absorb urine and help keep the skin dry. These will need to be changed and washed every few hours as needed as the pads are also used to collect feces and other discharges and must be removed before changing bed sheets.

U.S. Pat. No. 6,006,378 (Mitsuru Hayashi) discloses a bed which permits changing of bedclothes without moving the person on it and without substantial burden for either the patient or the care-taker. A left and a right carriage member 5 and 6, wheels 15 to 18 and a shaft 7 constitute a carriage. The carriage supports mats 11 and 12 via balancing members 3 and 4 and shafts 1 and 2 and advances the mats 11 and 12 along rails 31 and 32. The mat 12 is stretched between the rails 31 and 32 by fasteners. The balancing members 3 and 4 are rotatably coupled by a shaft to downward extensions 5a and 6a of the carriage members 5 and 6. The shafts 1 and 2 are rotatably mounted in the balancing members 3 and 4. With advancement of the carriage caused by turning a grip 26, the slides 52 and 54 cause the old mat 12 to be released from the fasteners and wound on the shaft 2, while also causing the new mat 11 to be coupled to the fasteners and stretched between the rails 31 and 32.

U.S. Pat. No. 6,594,837 (George Khait) discloses a service bed comprising a chassis, a guide mechanism movably supported by the chassis, and a mattress having an undulation formed by routing the mattress through the guide mechanism. The guide mechanism includes dispensing and collecting rollers for installing at least one first stratum between the mattress and the occupant of the service bed and for removing at least one second stratum installed between the mattress and the occupant.

U.S. Pat. No. 7,191,479 (Xiao-Zhou Cheng) discloses a hospital bed that changes bed sheets without moving the patient. It is composed of a bedstead (including a headboard, a footboard and a bed frame), a deformable bed top, a spool rack and roller shafts on both sides; the ends of the deformable bed top are fixed on the headboard and footboard respectively, and the bed top is pressed into between the roller axles by the spool rack which forms a tightened and leveled bed top that is sunken in the spool rack. Two bed sheets cover the bed, extending respectively from headboard and footboard into the spool rack and rolling on a roller axle. The roller axles and roller shafts are parallel to the cross section of the bed, and are movable between the headboard and footboard with the spool rack. When the spool rack is moving, one bed sheet is spread, another one is rolled up automatically.

This invention improves on the deficiencies of the prior art and provides an inventive bed apparatus which allows the seamlessly changing of bed-sheets while the bed is occupied by a person, and a method thereof.

PURPOSES AND SUMMARY OF THE INVENTION

The invention is a novel ultimate comfort n care bed, and a bed apparatus capable of seamlessly changing bed sheets while being occupied by a person, a method of relieving ulcers, and a method thereof.

The inventive hospital bed contains multiple features that allow spool rack to transverse freely across a hospital bed mattress while removing/dispensing bed-sheets without moving the patient.

The inventive hospital bed also incorporates features that reduce the force required to move carriage assembly across the bed using a pulley assembly, a roller assembly, air bladders, belts, and any combination of them.

Therefore, one purpose of this invention is to provide a cost effective and durable hospital bed capable for allowing of seamlessly changing bed sheets while being occupied by a patient.

Another purpose of this invention is to provide a hospital bed where the changing mechanism for the bed sheets is below a patient and does not interfere with the comfort of the patient.

Another purpose of this invention is to provide an inventive mechanism where while a used bed sheet is being removed from the medical bed a new bed sheet is automatically being replaced in its place.

Therefore, in one aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said frame, such that said primary mattress is longitudinally positioned between said headboard and said footboard;

(c) at least one carriage assembly in engagement contact with an upper surface of said primary mattress and wherein said at least one carriage assembly is longitudinally positioned between said headboard and said footboard;

(d) at least one pressure roller assembly below said primary mattress and in surface engagement with a bottom surface of said primary mattress;

(e) at least one means to move said at least one pressure roller assembly under said primary mattress from a first position to a second position; and (f) at least one means to move said at least one carriage assembly over said primary mattress from a first position to a second position.

In another aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said master bed frame, such that said primary mattress is longitudinally positioned between said headboard and said footboard;

(c) at least one carriage assembly in engagement contact with said primary mattress and wherein said at least one carriage assembly is positioned between said headboard and said footboard, such that said at least one carriage assembly is substantially parallel to said headboard and said footboard;

(d) at least one air bladder assembly, wherein said at least one air bladder assembly is inside said primary mattress;

(e) at least one air supply to increase or decrease air pressure inside said at least one air bladder assembly; and (f) at least one means to move said at least one carriage assembly over said primary mattress from a first position to a second position.

In yet another aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said master bed frame, such that said primary mattress is longitudinally positioned between said headboard and said footboard, (c) at least one carriage assembly in engagement contact with an upper surface of said primary mattress and wherein said at least one carriage assembly is longitudinally positioned between said headboard and said footboard;

(d) at least one pressure roller assembly below said primary mattress and in surface engagement with a bottom surface of said primary mattress;

(e) at least one means to move said at least one pressure roller assembly under said primary mattress from a first position to a second position;

(f) at least one carriage motor for moving said at least one carriage assembly over said primary mattress from a first position to a second position; and (g) wherein said at least one carriage motor travels over the top surface of said primary mattress at said second position while said pressure roller assembly exerts pressure on the bottom surface of said primary mattress at said second location to pull said primary mattress down and away from surface contact with at least a portion of said carriage assembly.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which:

FIG. 5A, shows a hospital bed in accordance to one embodiment of the present invention in which the primary mattress is in a substantially horizontal position while

FIG. 6A, shows a hospital bed in accordance to one embodiment of the present invention in which the primary mattress has been forced to move to a first stage with the use of a carriage assembly, while

FIG. 7A, shows a hospital bed in accordance to one embodiment of the present invention in which the primary mattress has been forced to move to a second stage with the use of a carriage assembly, while

DETAILED DESCRIPTION

Figure 1:
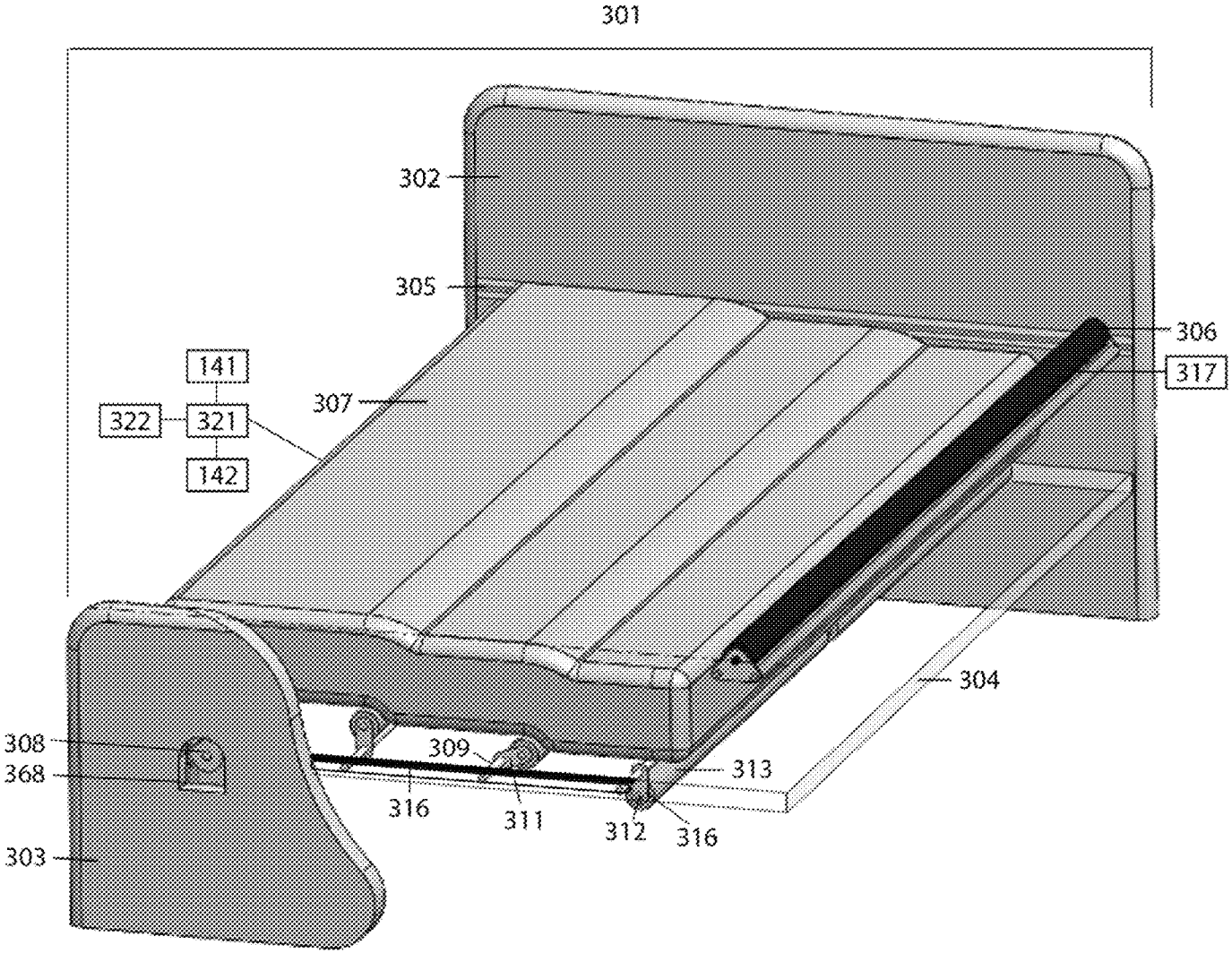
FIG. 1 is a top elevation view of a hospital bed in accordance to one embodiment of the present invention in which the pressure roller assembly is shown positioned in such a way as to lower sections of the primary mattress while elevating others.

The embodiments of the present invention are described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein. Rather, the disclosed embodiments are provided so that this disclosure will be thorough and complete, and will fully convey the scope of the invention to those skilled in the art.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

As shown in this invention, having the straps or the belts or the bladders or the mechanical carriage allows a service provider or a caregiver or a healthcare provider a much better access or room under the patient to remove the pads or mats or bed sheets while the patient or the person was still on the medical or hospital bed.

It would be advantageous to provide a hospital bed capable of seamlessly changing bed sheets while occupied by a patient because; it would be convenient to patients, caregivers, and healthcare providers by avoiding the traditional method, such as turning patient and/or lifting patient. It will reduce the cost of care for bedridden patient by decreasing the time spend and the number of the caregiver needed to assist in changing bed sheets. It will enhance safety of patients and caregivers by decreasing the hazard of physical injury and decreasing the health hazard of exposure to biological materials. It will help prevent pressure ulcers. Changing the bed sheet without moving the patient will eliminate the friction and shearing which are considered as major factor in development of pressure ulcer. It will reduce physical, psychological and emotional suffering that the bed bound patient and family are exposed to by using the traditional methods of changing the bed sheet. It would further be advantageous to provide a hospital bed capable of seamlessly changing bed sheets while occupied by a patient because it will reduce the risk of contamination and transmission of infectious by increasing the frequency of changing the bed sheet and minimizing the caregiver contact with patient's body and secretion. Belts or straps can be used also with alternating bladder mattress to reduce or prevent pressure ulcers and to change bed sheets.

A hospital bed that changes bed sheets without moving the patient. Comprised of a bedstead (foot/headboard), deformable bed top, spool rack and roller shafts on both sides. The ends of the deformable bed top are fixed on the head and footboard. The bed is pressed into and between the roller axles by the spool rack which forms a tightened and leveled bed top that is sunken in the spool rack. The two bed sheets cover the bed from head to foot board into spool rack and rolling on a roller.

As shown in FIGS. 1 through 7B, a medical or hospital bed 301, is capable of seamlessly changing bed sheets while being occupied by a patient, which includes a headboard 302 and footboard 303, connected to one another via a master bed frame 304 which utilizes a pivoting pressure roller assembly 315 atop of which there is placed a primary mattress 307. When each pressure roller 313 is in its default horizontal position, the primary mattress 307 remains parallel to the ground. However, as individual pressure rollers 313 of the pressure roller assembly 315 engage with a rotating roller shaft 309, they rotate away from the primary mattress 307. With the pressure roller 313 now supporting the primary mattress 307 at a lower level, if downward pressure is applied to the primary mattress 307 by either the weight of a patient or by the carriage assembly 306, the primary mattress 307 will sink down in this section. This process enables the primary mattress 307 to deform in such a way as to relieve pressure from under specific areas of the patient's body in order to reduce the likelihood of bedsores and/or other similar pressure related conditions and to facilitate patient healing. This process also enables the carriage assembly 306 to complete the bed sheet changing process without moving the patient.

Referring now to the FIGS. 1 through 7B, where FIG. 1 is a top elevation view of a medical or a hospital bed 301 in accordance to one embodiment of the present invention in which the pressure roller assembly 315 is shown positioned in such a way as to lower sections of the primary mattress 307 while elevating others. Referring to FIG. 1, the hospital bed 301, includes a headboard 302, and footboard 303, held together by a master bed frame 304 to which there is attached a pressure roller assembly 315, a primary mattress 307 and a carriage assembly 306. Mounted along the ends of the master bed frame 304 is a series of pivoting or rotating roller shafts 309. Attached to these roller shafts 309 are a series of slip clutches 310, and roller brackets 311, on the opposite side of which are pressure rollers 313 connected to the roller brackets 311 via roller pins 312. The roller shafts 309 are turned a by a timing belt 316 connected to a roller motor 308 housed in the footboard 303, such as, an opening 368, or a pocket 368, or a blind hole 368, to name a few, of the hospital bed 301. As the timing belt 316 rotates the roller shafts 309, electric slip clutches 310 attached to the roller brackets 311 prevent the roller brackets 311 from rotating until engaged by the slip clutches 310. Once engaged, the roller brackets 311 will be able to away from their default vertical position. If downward pressure is applied to the primary mattress 307 by the patient or the carriage assembly 306, the primary mattress 307 will begin to sink as the pressure rollers 313 are turned away from the primary mattress 307 relieving pressure from underneath the patient and/or creating a pocket 50, into which the carriage assembly 306 can fit. As the carriage motor 317 begins to turn it will engaging with the gear rack 334, and move the carriage assembly 306 along the carriage sliding frame 305. As the carriage assembly 306 moves across the primary mattress 307, the pressure rollers 313 ahead of it will be turned down to create a new pocket 50, while the pressure rollers behind will rotate back up to push the rest of the primary mattress 307 into its to default horizontal position. In this way, the pressure roller assembly 315 is able to lessen pressure from underneath the primary mattress 307 in such a way as to create moving pockets 50, large enough to allow the carriage assembly 306 to pass freely over the primary mattress 307 from one end of the hospital bed 301 to another without tension. Thus, the carriage assembly 306, will able to traverse from one side of the hospital bed 301, to the other side, rolling up a used bed sheet 319, and rolling out a new bed sheet 320, simultaneously, as the pressure roller assembly 315, maneuvers to allow the carriage assembly 306, space to freely move therein and complete the bed sheet changing process. Alternatively, the roller motor 308, could be housed in the headboard 302, such as, an opening 368, or a pocket 368, or a blind hole 368, to name a few, within the headboard 302, similar to the one shown with reference to footboard 303, or each roller shaft 309, could feature its own roller motor 308.

Figure 2A:
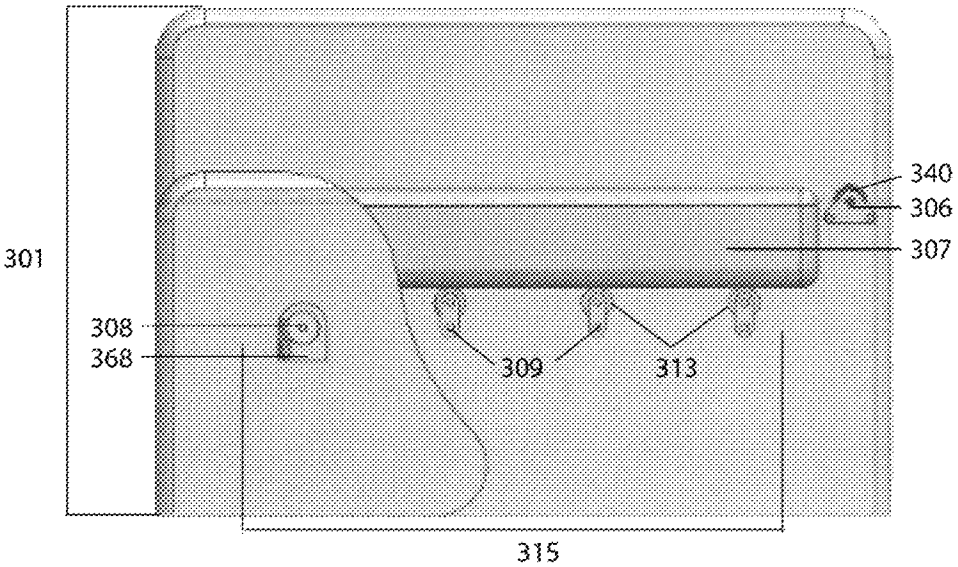
FIG. 2A is a front view of hospital bed in accordance to one embodiment of the present invention in which the primary mattress is resting in its default horizontal position.

FIG. 2A is a front view of hospital bed 301 in accordance to one embodiment of the present invention in which the primary mattress 307 is resting in its default horizontal position.

Figure 2C:
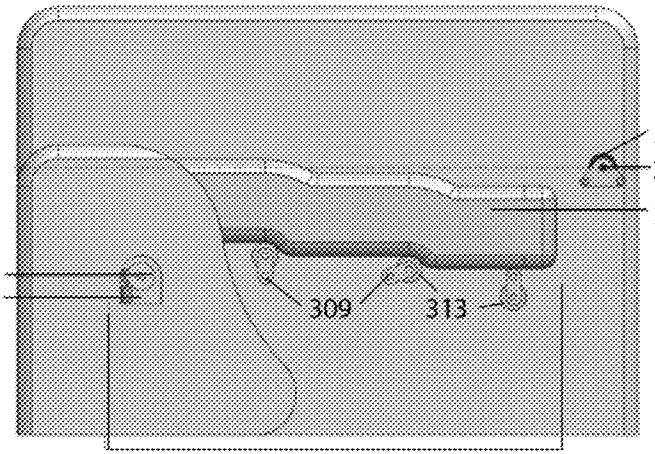
FIG. 2C is a front view of hospital bed in accordance to one embodiment of the present invention in which the pressure roller assembly is shown positioned in such a way as to further lower sections of the primary mattress while elevating others.
Figure 2B:
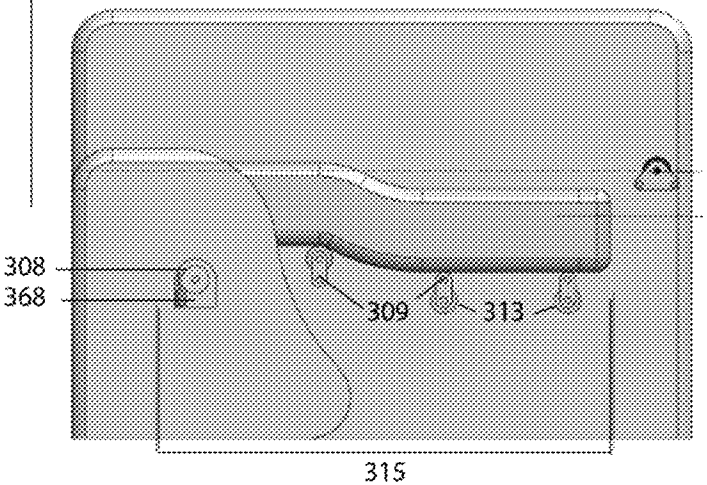
FIG. 2B is a front view of hospital bed in accordance to one embodiment of the present invention in which the pressure roller assembly is shown positioned in such a way as to lower sections of the primary mattress while elevating others.

FIG. 2B is a front view of hospital bed 301 in accordance to one embodiment of the present invention in which the pressure rollers assembly 315 is rotating some of its pressure rollers 313 to allow the primary mattress 307 to deform in order to relieve pressure from beneath the patient and/or create enough space for the carriage assembly 306 to fit therein.

FIG. 2C is a front view of hospital bed 301 in accordance to one embodiment of the present invention in which the pressure roller 313 to allow the primary mattress 307 to further deform in order to relieve pressure from beneath the patient and/or create enough space for the carriage assembly 306 to fit therein.

Figure 3:
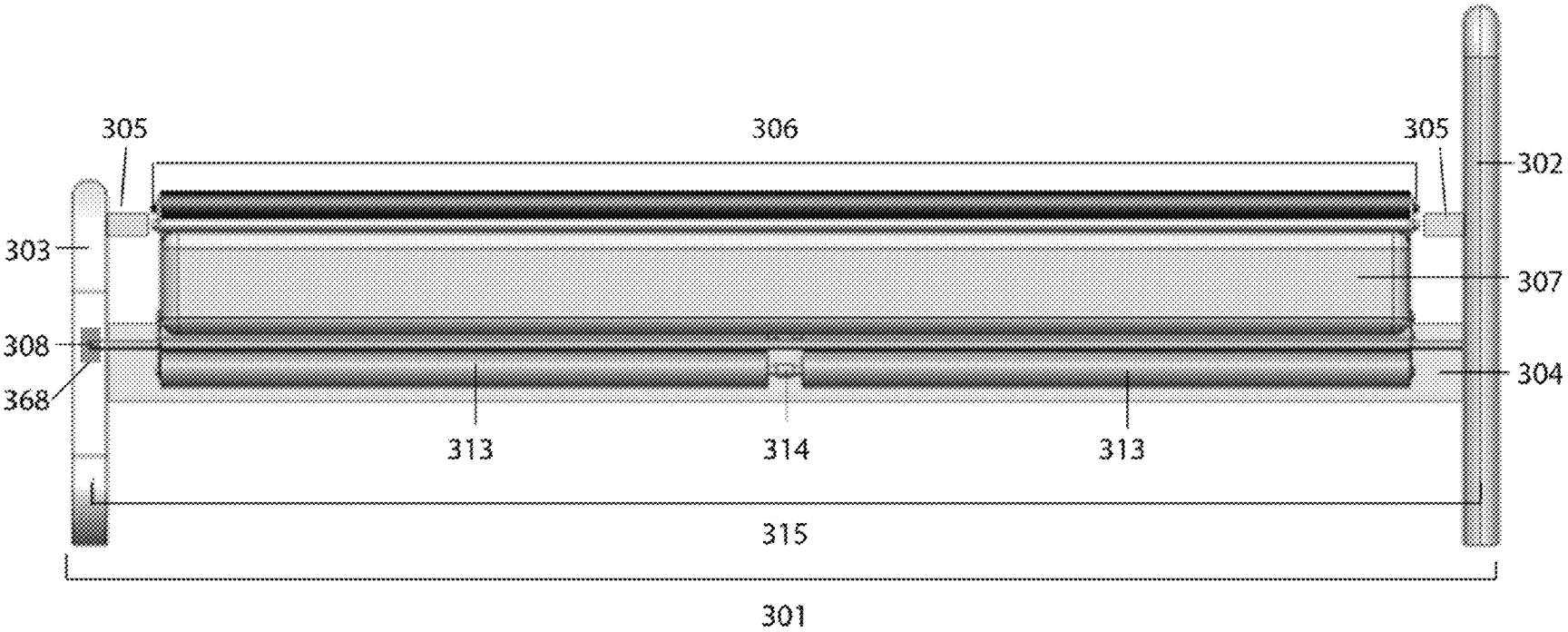
FIG. 3 is an side view of the hospital bed in accordance to one embodiment of the present invention in which the tension arc assembly is shown positioned in such a way that the primary mattress is in it's default horizontal position.

FIG. 3 is an side view of the hospital bed 301 in accordance to one embodiment of the present invention in which the primary mattress 307 in a default horizontal position in which the pressure roller assembly, and carriage assembly 306 and master bed frame 304 are shown. A union joint 314 connecting two pressure rollers 313 together is also visible in order to allow the head or foot of the bed to be lifted without adversely affecting the ability of the pressure roller assembly 315 to support the primary mattress 307 at various levels of compression. Located within the control box 321, as shown in FIG. 1, there is a central processing unit (CPU) 141, a power supply 142, and any other necessary parts to make the hospital bed 301, function along with a programmable logic control (PLC) 322, to determine the sequence of operation for the entire hospital bed 301.

Figure 4:
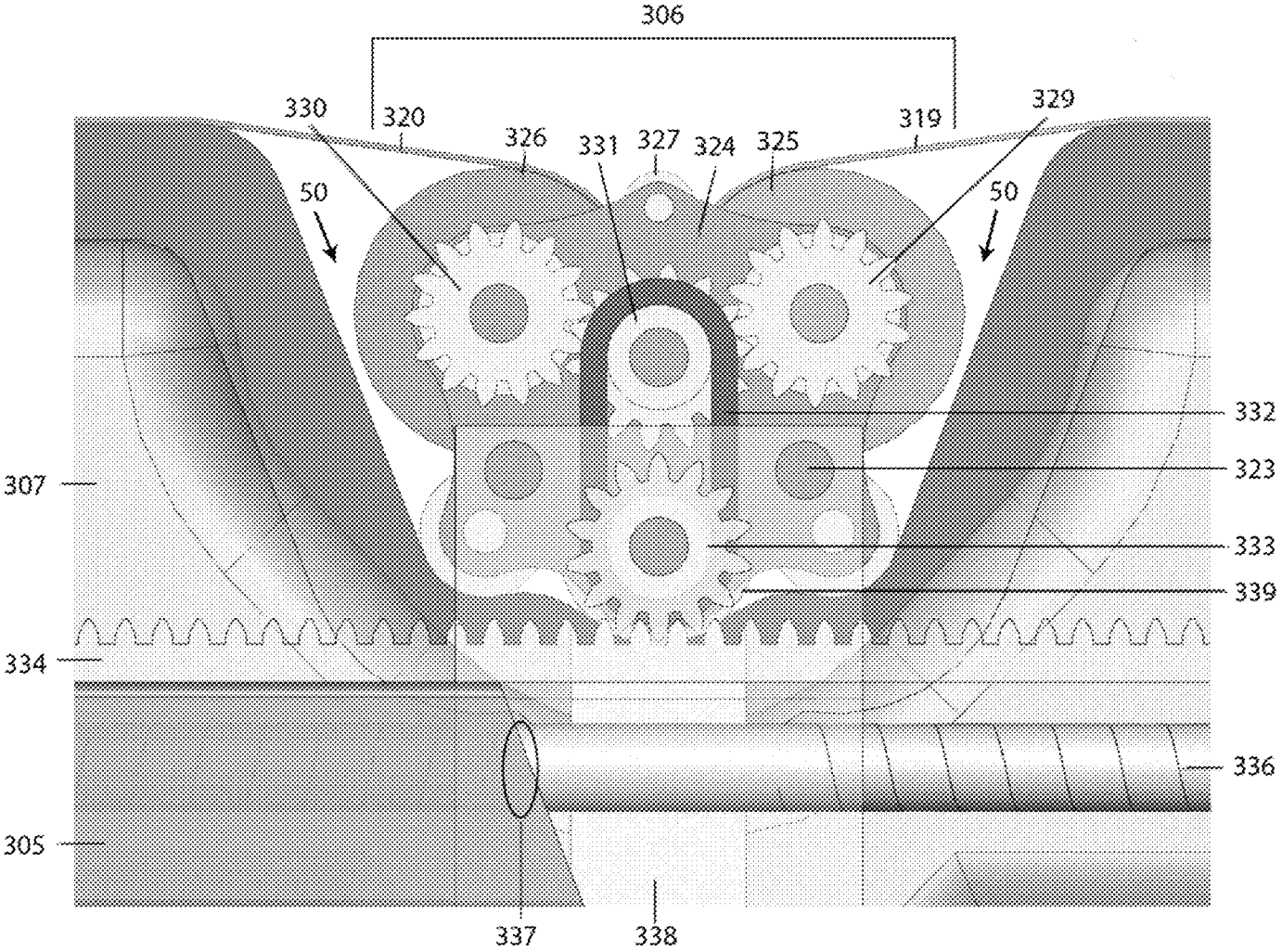
FIG. 4 shows a hospital bed in accordance to one embodiment of the present invention in which the carriage assembly and is enlarged to show greater detail.

FIG. 4 shows hospital bed 301 in accordance to one embodiment of the present invention in which the carriage assembly 306 is enlarged to show greater detail. The carriage assembly 306 is held together by series of mounting rods 323 and a mounting bracket 324 on either end on the top of which there are inserted a used bed sheet roller 325 and a new bed sheet roller 326 parallel to one another. Between these bed sheet rollers 325, 326, and at a slightly higher level, there is located a padded support roller 327 which prevents the patient's back from touching the rotating bed sheet rollers 325, 326, as they simultaneously roll up the used bed sheet 319 and roll out the new bed sheet 320 as the carriage assembly 306 moves across the primary mattress 307. Bearings 328, are placed throughout the holes of the mounting bracket 324 to facilitate the free rotation of the attached rollers and gears. The carriage assembly 306 also includes a series of belts, gears and slip clutches which work together to both move the carriage assembly 306 across the primary mattress 307 as well as complete the bed changing process at the same time. This is accomplished using a used bed sheet roller gear 329 and a new bed sheet roller gear 330 which are attached to both ends of the used bed sheet roller 325 and new bed sheet roller 326 respectively. A slip clutch 310, as shown in FIG. 1, is inserted onto either end of the bed sheet rollers 325, 326, between the mounting bracket 324 the roller gears to prevent bed sheet rollers 325, 326, from rotating when anything obstructs the rolling process the used bed sheet 319, and the new bed sheet 320, in order to protect the patient and bed components from being injured and damaged. The used bed sheet roller gears 329, and new bed sheet roller gear 330, are connected via a center belt gear 331 located at the center of the mounting bracket 324. Depending on the direction of the rotation of the center belt gear 331, the bed sheet gears 329, 330, will either rotate clockwise or counter-clockwise in conjunction with the movement of the carriage assembly 306 in such a way that the used bed sheet roller 325 rolls up the used bed sheet 319 while the new bed sheet roller 326 rolls up the new bed sheet 320. The center belt gear 331 is connected to the master rack gear 333 via a center belt 332 which transfers the rotation of the master rack gear 333 to the center belt 332 which in turn, rotates both bed sheet gears 329, 330. The master rack gear 333 engages a gear rack 334 affixed the carriage sliding frame 305. The carriage assembly 306 is moved from one end of the bed 301, to the other end by a carriage motor 317, shown in FIG. 1, to which there is attached a threaded carriage rod 336. At the base of the mounting plate 338 there is attached a threaded hole 337, into which the threaded carriage rod 336, is inserted. As the threaded carriage rod 336 rotates, so does the master rack gear 333 moving the carriage along the sides of the bed and starting the bed changing process. A master rack gear 333 is affixed to both ends of a master pressure roller 339 to apply downward pressure on the primary mattress 307 to create clearance or pocket 50, for the carriage assembly 306 to freely move across the bed. For safety reasons, a gear cover 340, is used to cover all exposed gears and belts of the carriage assembly 306. Located within the control box 321, shown in FIG. 1, there is a Central Processing Unit (CPU) 140, a power supply 142, and any other necessary parts to make the hospital bed 301, function along with a programmable logic control (PLC) 322, to determine the sequence of operation for the entire hospital bed 301.

Figure 5A:
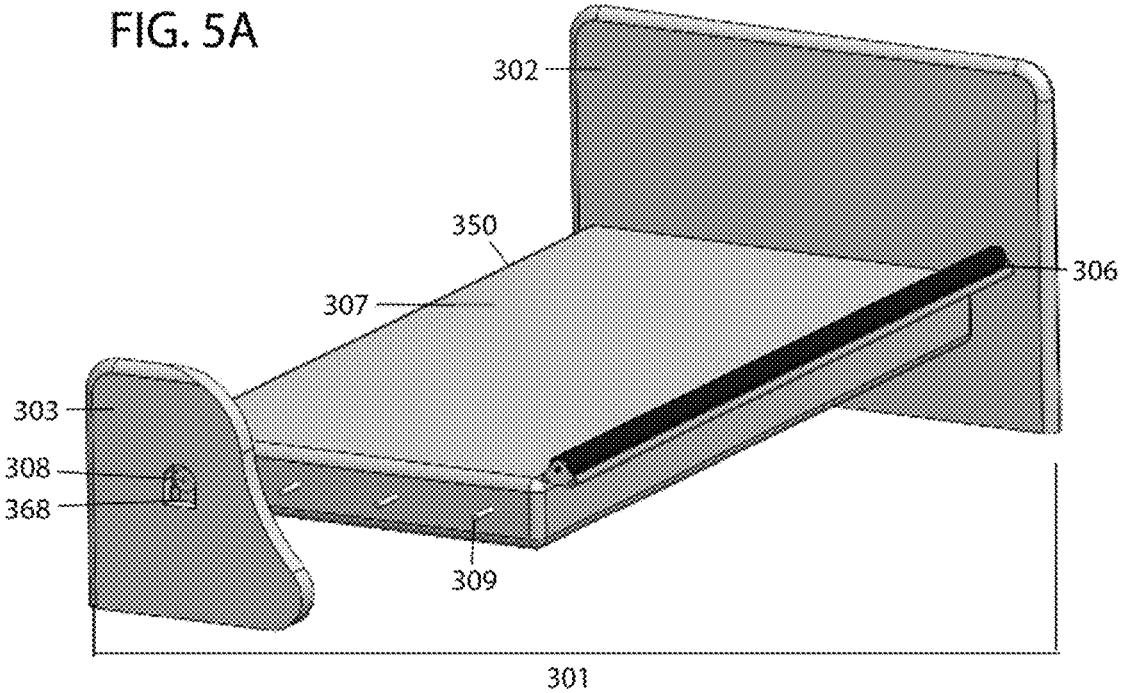
Figure 5B:
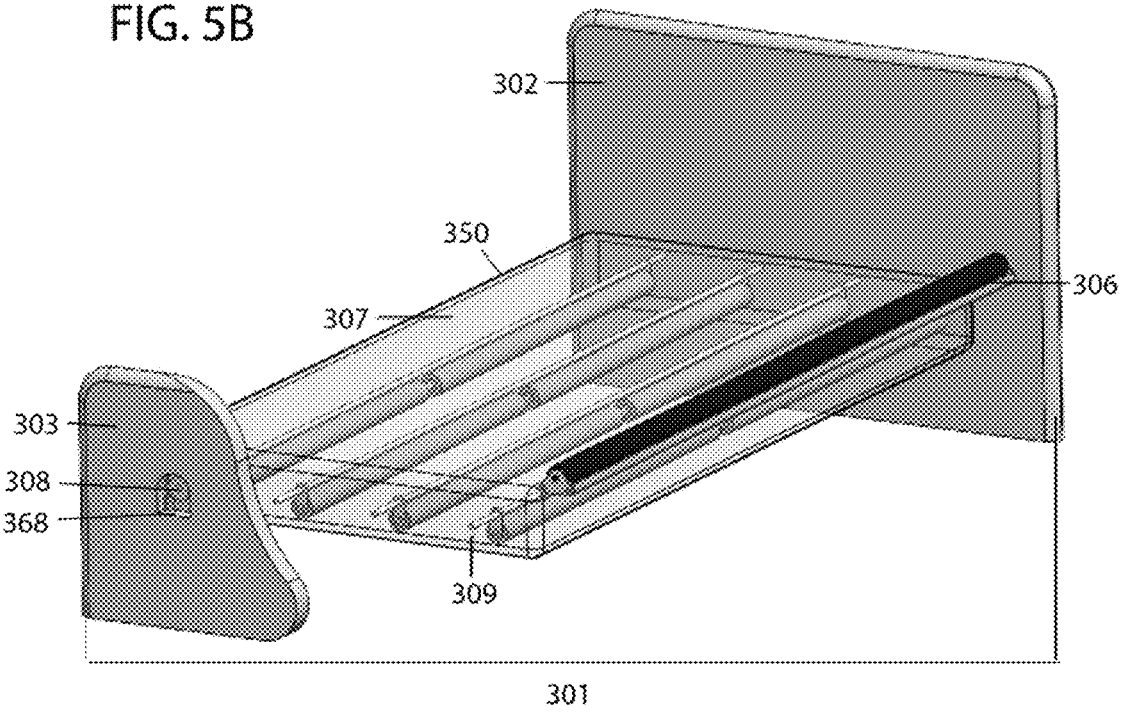
FIG. 5B, shows the carriage assembly with the portions of the primary mattress removed.

FIG. 5A, shows a hospital bed 301, in accordance to one embodiment of the present invention in which the primary mattress 307, is in a substantially horizontal position 350, while FIG. 5B, shows the carriage assembly 306, with the portions of the primary mattress 307, removed for the substantially horizontal position 350.

Figure 6A:
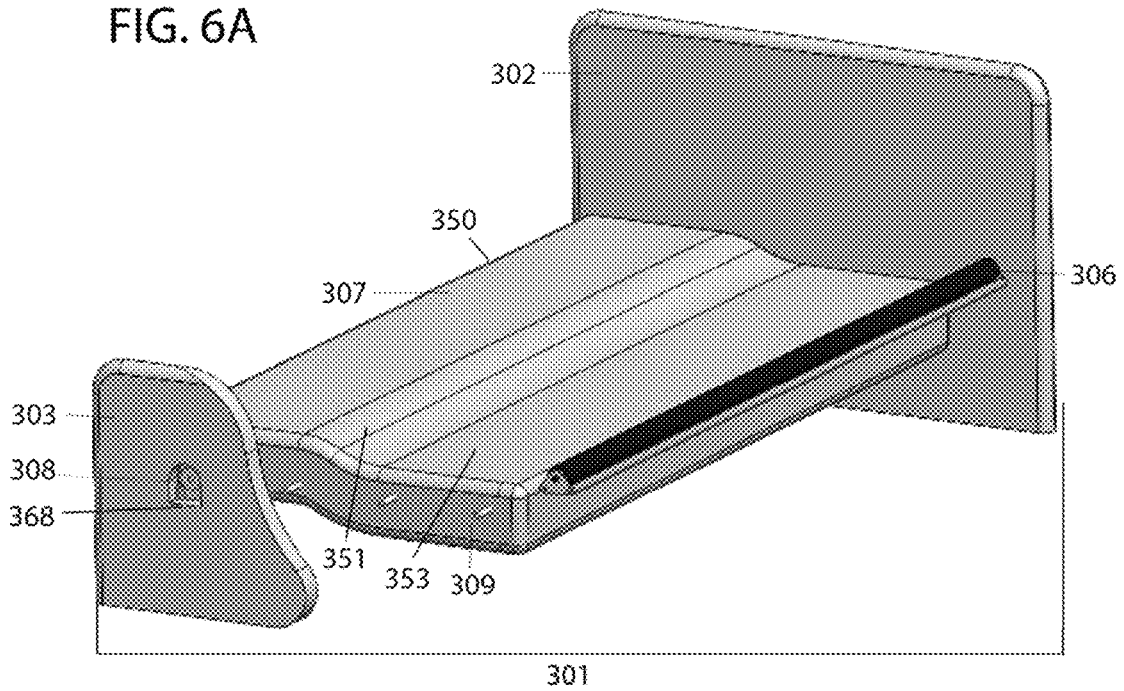
Figure 6B:
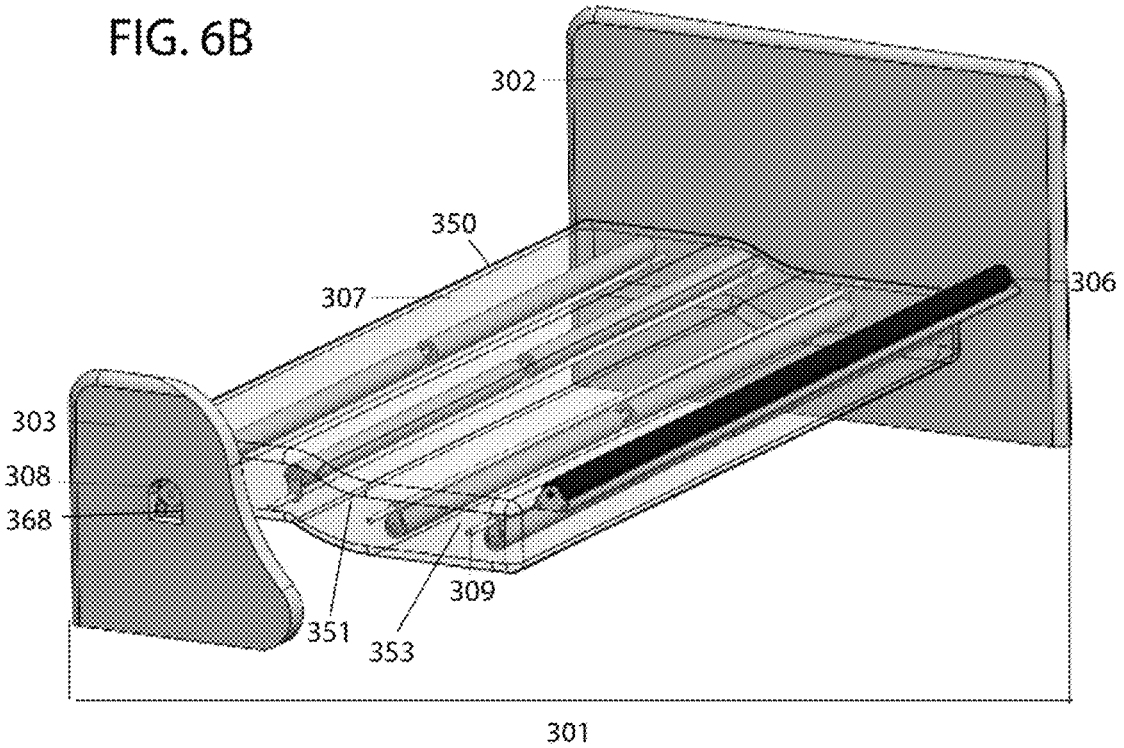
FIG. 6B, shows the carriage assembly with the portions of the primary mattress removed in the first stage.

FIG. 6A, shows a hospital bed 301, in accordance to one embodiment of the present invention in which the primary mattress 307, has been forced to move to a first stage 351, with the use of a carriage assembly 306, while FIG. 6B, shows the carriage assembly with the portions of the primary mattress removed in the first stage 351. As one can see that the primary mattress 307, for the bed 301, on one side is in a substantially horizontal position 350, while a portion of the same primary mattress 307, is in a dipped down position 353, during the first stage 351.

Figure 7A:
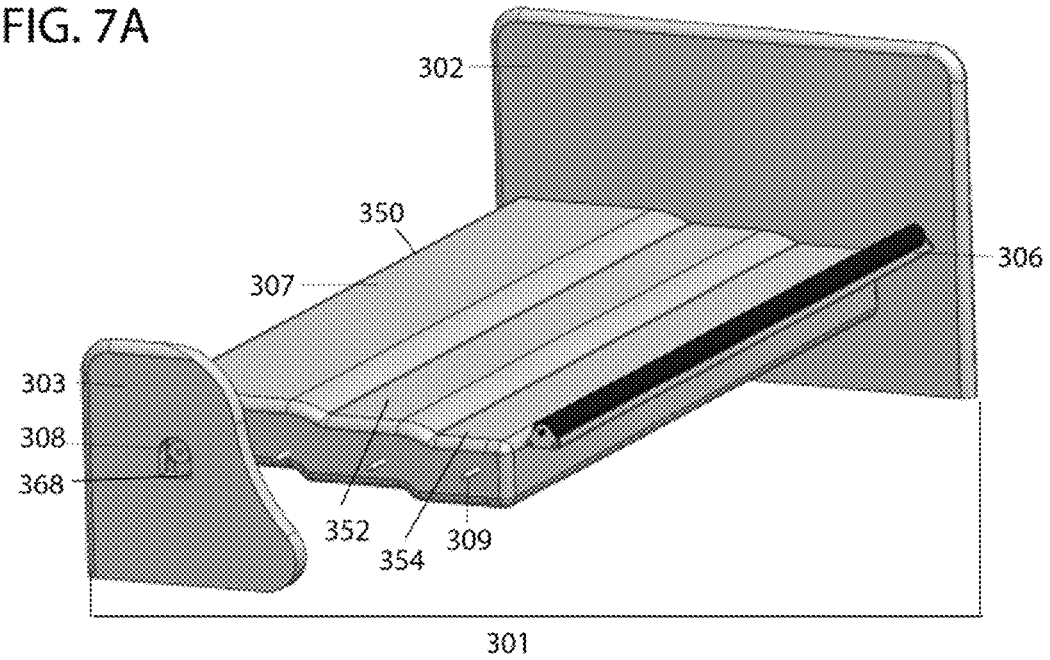
Figure 7B:
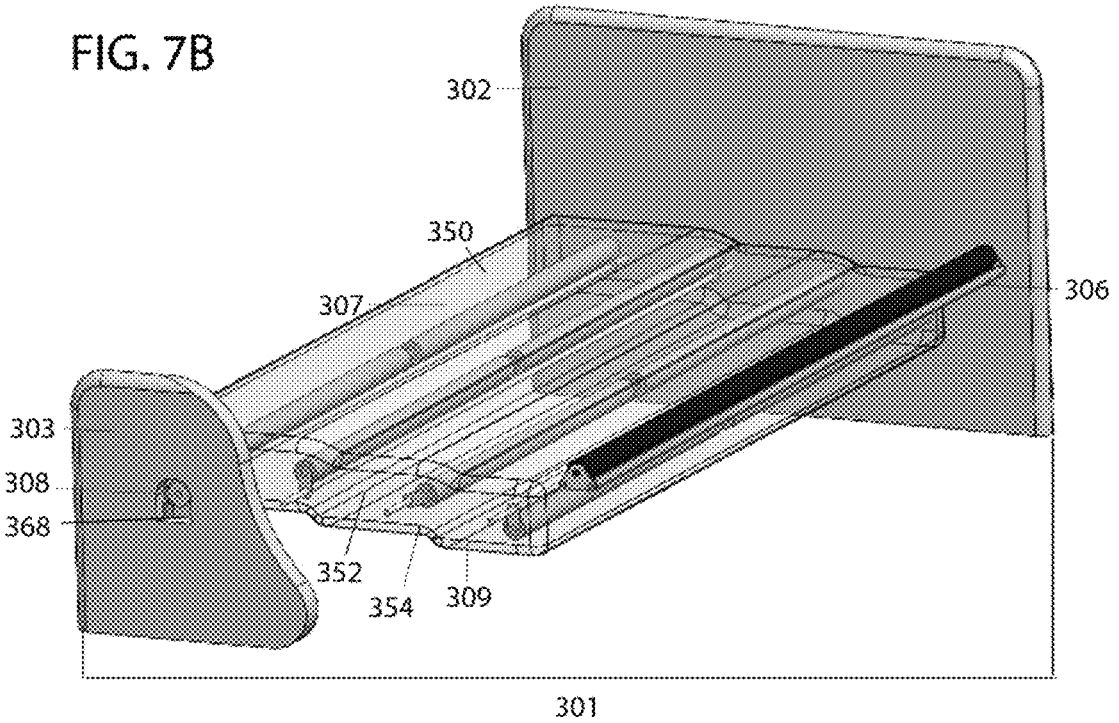
FIG. 7B, shows the carriage assembly with the portions of the primary mattress removed in the second stage.

FIG. 7A, shows a hospital bed in accordance to one embodiment of the present invention in which the primary mattress has been forced to move to a second stage 352, with the use of a carriage assembly, while FIG. 7B, shows the carriage assembly with the portions of the primary mattress removed in the second stage 352. As one can see that the primary mattress 307, for the bed 301, on one side is in a substantially horizontal position 350, while a portion of the same primary mattress 307, is in a dipped down position 354, during the second stage 352.

As shown in FIGS. 8 through 11, a medical or hospital bed 501, is capable of seamlessly changing bed sheets while being occupied by a patient, which includes a headboard 502 and footboard 503, connected to one another via a master bed frame 504 which utilizes a primary mattress 507 inside of which there is located an air bladder assembly 515 which inflates and deflates its series of air bladders as needed to relieve pressure from beneath the patient and provide an air exchange between the primary mattress 507 and the patient to reduce the likelihood of bedsores, infections and/or other similar pressure related conditions, to facilitate patient healing and to reposition the patient as needed. This process also enables the carriage assembly 506 to easily compress the primary mattress 507 and complete the bed sheet changing process without moving the patient.

Figure 8:
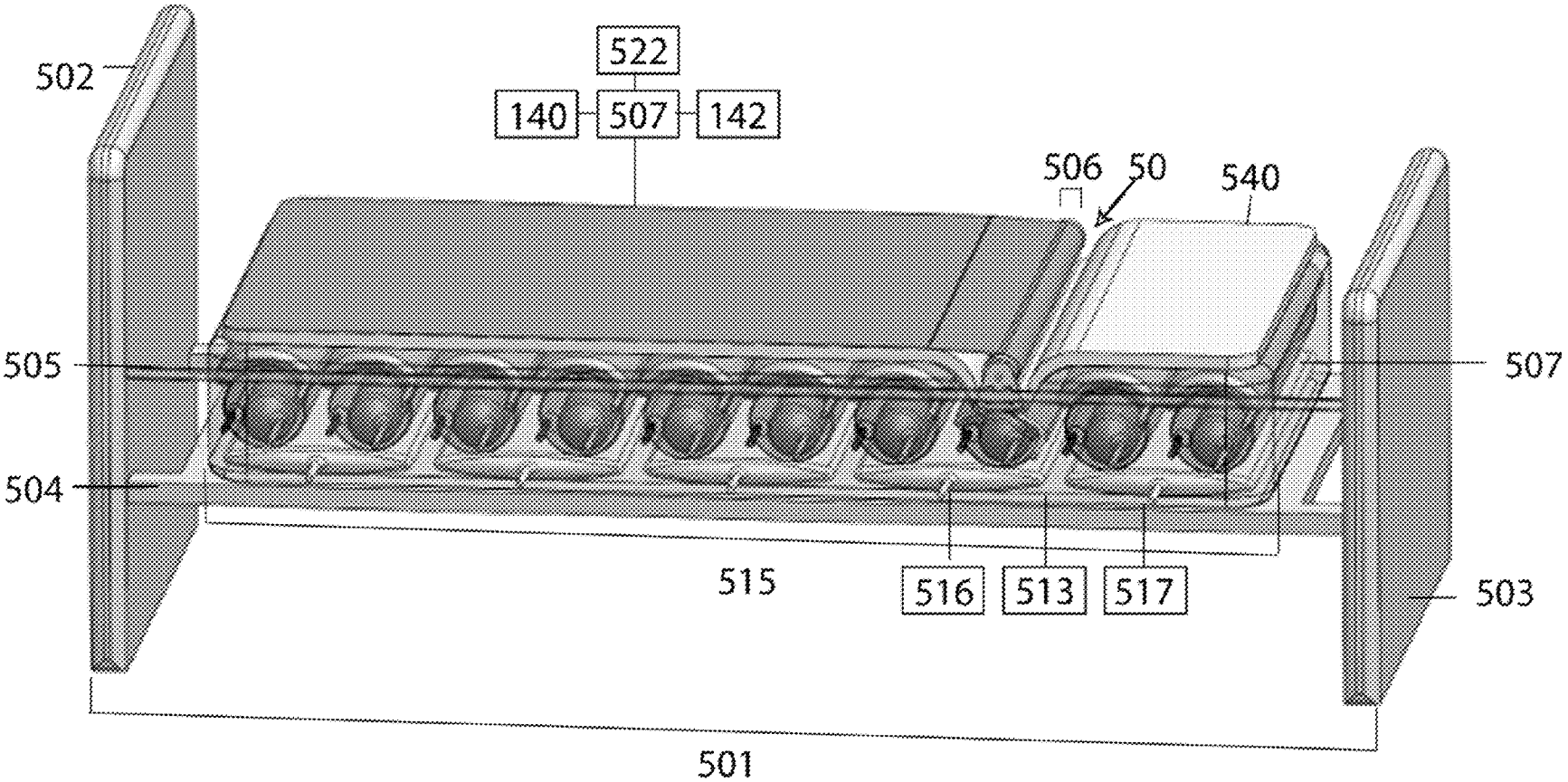
FIG. 8 is a top elevation view of a hospital bed in accordance to another embodiment of the present invention in which the air bladder assembly and carriage assembly are shown.

Referring now to the FIGS. 8 through 11, where FIG. 8, is a top elevation view of a hospital bed 501 in accordance to one embodiment of the present invention in which the air bladder assembly 515 and carriage assembly 506 are shown. Referring to FIG. 8, the hospital bed 501, includes a headboard 502 and footboard 503 held together by a master bed frame 504 onto which there is placed a primary mattress 507 which contains an air bladder assembly 515. A carriage assembly 506, and carriage sliding frame 505, are also shown.

Figure 9:
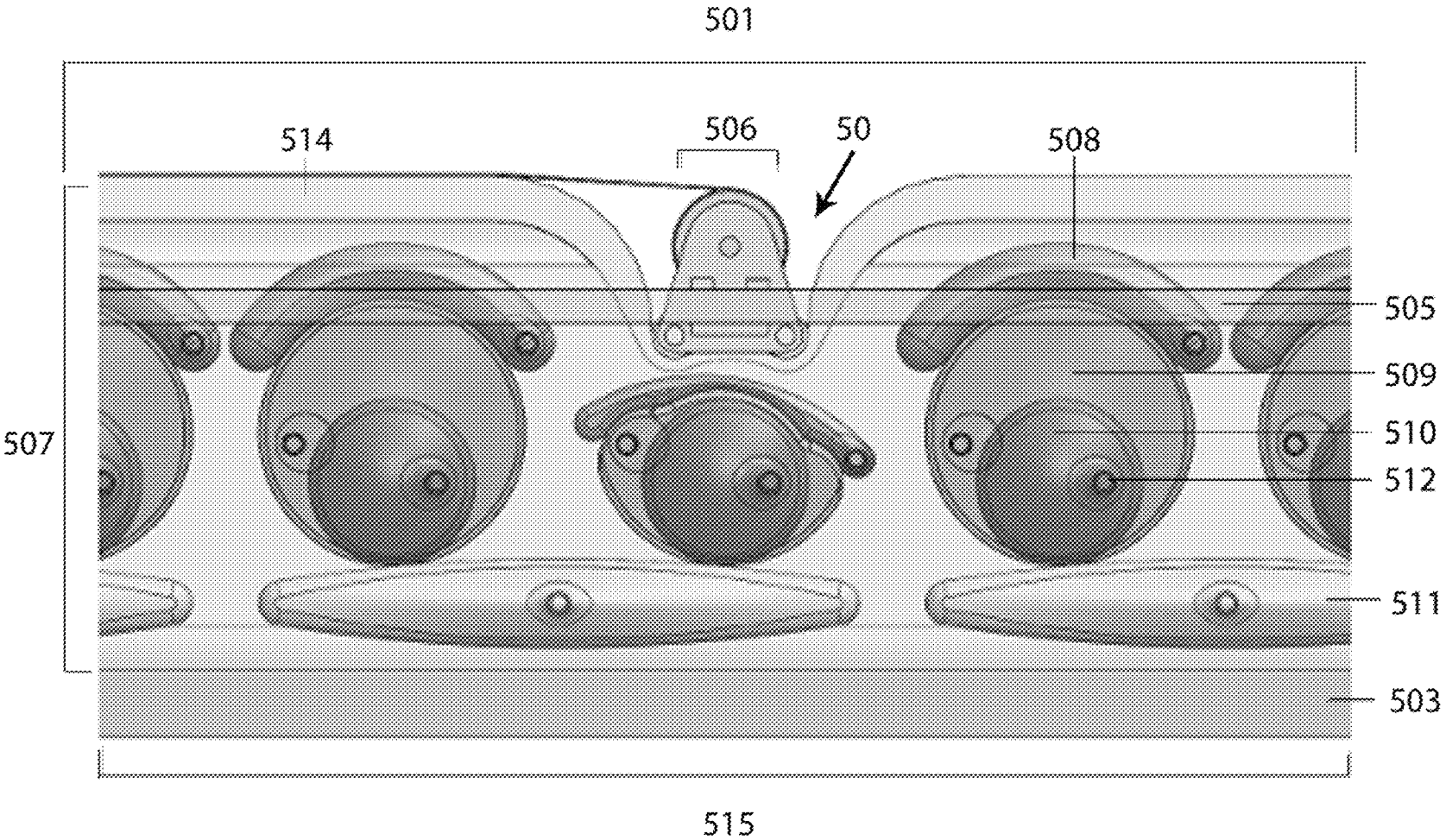
FIG. 9 is a detailed view of hospital bed in accordance to another embodiment of the present invention in which the air bladder assembly is enlarged to show greater detail.

FIG. 9 is a detailed view of hospital bed 501 in accordance to one embodiment of the present invention in which the air bladder assembly 515 is enlarged to show greater detail. The air bladder assembly 515 is comprised of a breathable top bladder 508, an outer bladder 509, an inner bladder 510, an adjustment bladder 511, a series of solenoid valves 512, air tubes 516 and an air supply 513. The breathable top bladders 508 used to create an air exchange between the patient's body and the primary mattress 507 in order maintain a dry, sterile environment under the patient which reduces the likelihood of bedsores, infections and/or other similar pressure related conditions and to facilitate patient healing and comfort. Positioned directly underneath each breathable top bladder 508 is an outer bladder 509 within which there is a smaller inner bladder 510. The breathable top bladders 508, outer bladders 509 and inner bladders 510 are designed in such a way that when downward pressure is applied to the primary mattress 507 by either the weight of a patient or by the carriage assembly 506 these bladders will automatically begin to deflate relieving pressure from underneath the patient and/or creating a pocket 50, into which the carriage assembly 506 will be able to fit. The more pressure applied, the more the bladders will deflate. The order in which this deflation occurs is, breathable top bladders 508 first, outer bladders 509 second and inner bladders 510 last. If pressure is relieved from the bladders 508, 509, 510, order is reversed as the inner bladders 510, outer bladders 509 and top bladders 508, begin to inflate respectively bringing the primary mattress 507 back to its default horizontal position parallel to the ground. Bottom adjustment bladders 511 are can be inflated and deflated under the rest of the bladders to raise up or lower sections of the primary mattress 507, such as the head/chest, the knee or foot areas, as desired by the patient or the caregiver.

Every bladder features a solenoid valve 512 which will close to prevent air from escaping during the bed sheet changing process. This will enable all the bladders which are not being compressed by the carriage assembly 506 to maintain full bladder inflation and support the patient. If downward pressure is applied to the primary mattress 507 by the patient or the carriage assembly 506, the bladders directly underneath it will begin to deflate, while the bladders to either side of the carriage assembly 506 will maintain full inflation due to the closing of their solenoid valves 512. This process will cause the primary mattress 507 to sink down in the middle creating a pocket 50, into which the carriage assembly 506 can fit. As the carriage motor 517, begins to turn it will engaging with the gear rack 534, and move the carriage assembly 506 along the carriage sliding frame 505. As the carriage assembly 506 moves across the primary mattress 507, the bladders ahead of it will deflate to create a new pocket 50, while the bladders behind will inflate to push the rest of the primary mattress 507 back into its to default horizontal position. In this way, the air bladder assembly 515 is able to lessen pressure from underneath the primary mattress 507 in such a way as to create moving pockets 50, large enough to allow the carriage assembly 506 to pass freely over the primary mattress 507 from one end of the hospital bed 501 to another without tension. Thus, the carriage assembly 506 will able to traverse from one side of the hospital bed 501, to the other side, rolling up a used bed sheet 519, and rolling out a new bed sheet 520, simultaneously, as the air bladder assembly 515, maneuvers to allow the carriage assembly 506 space to freely move therein and complete the bed sheet changing process. All the bladders are inflated and deflated by an air supply 513 via a series of air tubes 516. A thin breathable secondary mattress 514 is placed on top of the primary mattress 507 and under the bed sheets 519, 520, to enable the free air exchange of the breathable top bladders to the patient.

Figure 10:
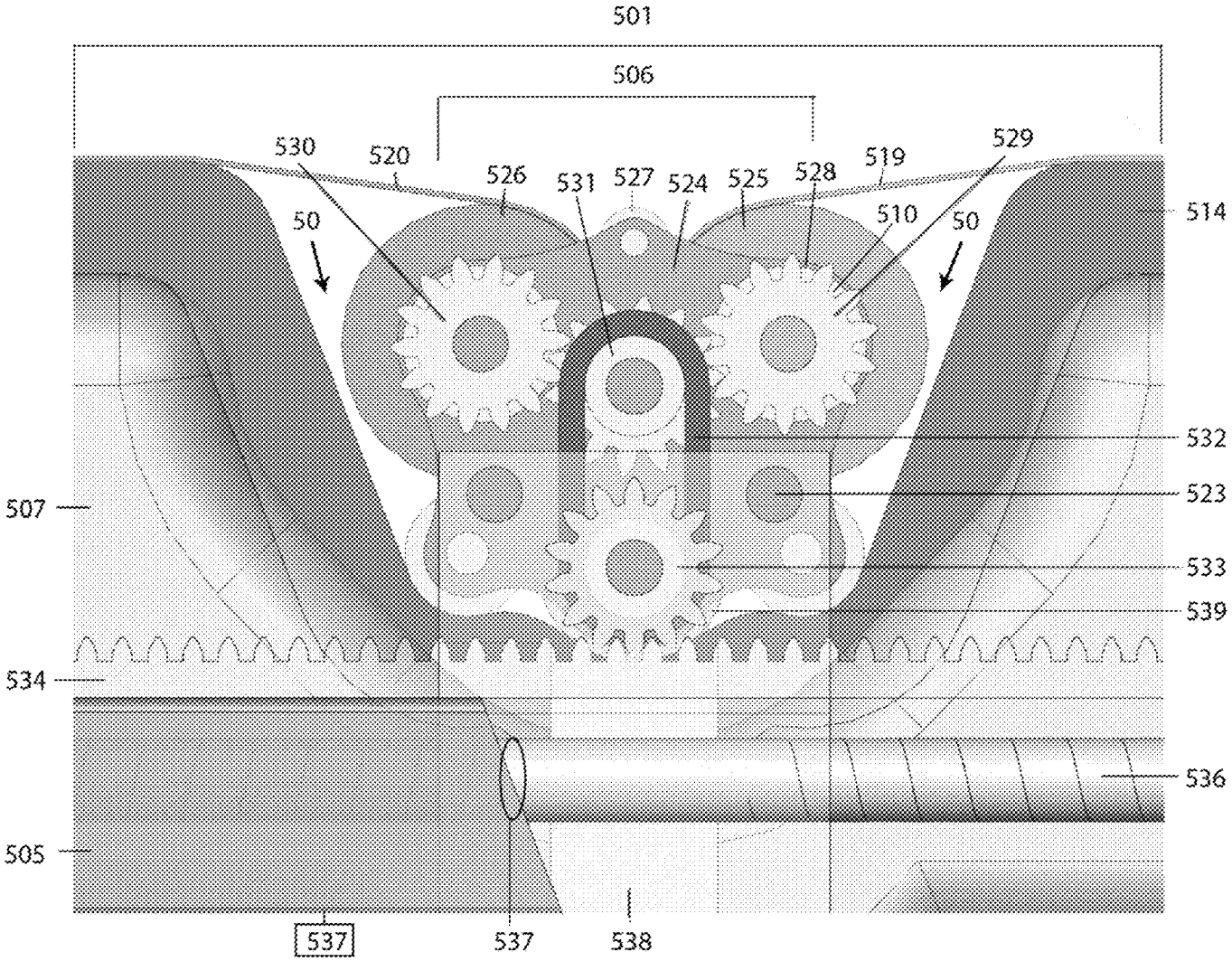
FIG. 10 is a detailed view of a hospital bed in accordance to another embodiment of the present invention in which the carriage assembly 506 is enlarged to show greater detail.

FIG. 10, shows hospital bed 501 in accordance to one embodiment of the present invention in which the carriage assembly 506 is enlarged to show greater detail. The carriage assembly 506 is held together by series of mounting rods 523 and a mounting bracket 524 on either end on the top of which there are inserted a used bed sheet roller 525 and a new bed sheet roller 526 parallel to one another. Between these bed sheet rollers 525, 526, and at a slightly higher level, there is located a padded support roller 527 which prevents the patient's back from touching the rotating bed sheet rollers 525, 526, as they simultaneously roll up the used bed sheet 519 and roll out the new bed sheet 520 as the carriage assembly 506 moves across the primary mattress 507. Bearings 528, are placed throughout the holes of the mounting bracket 524 to facilitate the free rotation of the attached rollers and gears. The carriage assembly 506 also includes a series of belts, gears and slip clutches which work together to both move the carriage assembly 506 across the primary mattress 507 as well as complete the bed changing process at the same time. This is accomplished using a used bed sheet roller gear 529 and a new bed sheet roller gear 530 which are attached to both ends of the used bed sheet roller 525 and new bed sheet roller 526, respectively. A slip clutch 510, is inserted onto either end of the bed sheet rollers between the mounting bracket 524 the roller gears to prevent bed sheet rollers 525, 526, from rotating when anything obstructs the rolling process the used bed sheet 519, and the new bed sheets 520, in order to protect the patient and bed components from being injured and damaged. The used bed sheet roller gears 529, and new bed sheet roller gear 530, are connected via a center belt gear 531 located at the center of the mounting bracket 524. Depending on the direction of the rotation of the center belt gear 531, the bed sheet gears will either rotate clockwise or counter-clockwise in conjunction with the movement of the carriage assembly 506 in such a way that the used bed sheet roller 525 rolls up the used bed sheet 519 while the new bed sheet roller 526 rolls out the new bed sheet 520. The center belt gear 531 is connected to the master rack gear 533 via a center belt 532 which transfers the rotation of the master rack gear 533 to the center belt 532 which in turn, rotates both bed sheet gears. The master rack gear 533 engages a gear rack 534 affixed the carriage sliding frame 505. The carriage assembly 506 is moved from one end of the bed to the other by a carriage motor 517, shown in FIG. 8, to which there is attached a threaded carriage rod 536. At the base of the mounting plate 538 there is attached a threaded hole 537, into which the threaded carriage rod 536, is inserted. As the threaded carriage rod 536 rotates, so does the master rack gear 533 moving the carriage along the sides of the bed and starting the bed changing process. A master rack gear 533 is affixed to both ends of a master pressure roller 539 to apply downward pressure on the primary mattress 507 to create clearance for the carriage assembly 506 to freely move across the bed. For safety reasons, a gear cover 540, as shown in FIG. 8, is used to cover all exposed gears and belts of the carriage assembly 506. Located within the control box 507, as shown in FIG. 8, there is a Central Processing Unit (CPU) 140, a power supply 142, and any other necessary parts to make the hospital bed 501, function along with a programmable logic control (PLC) 522, to determine the sequence of operation for the entire hospital bed 501.

Figure 11:
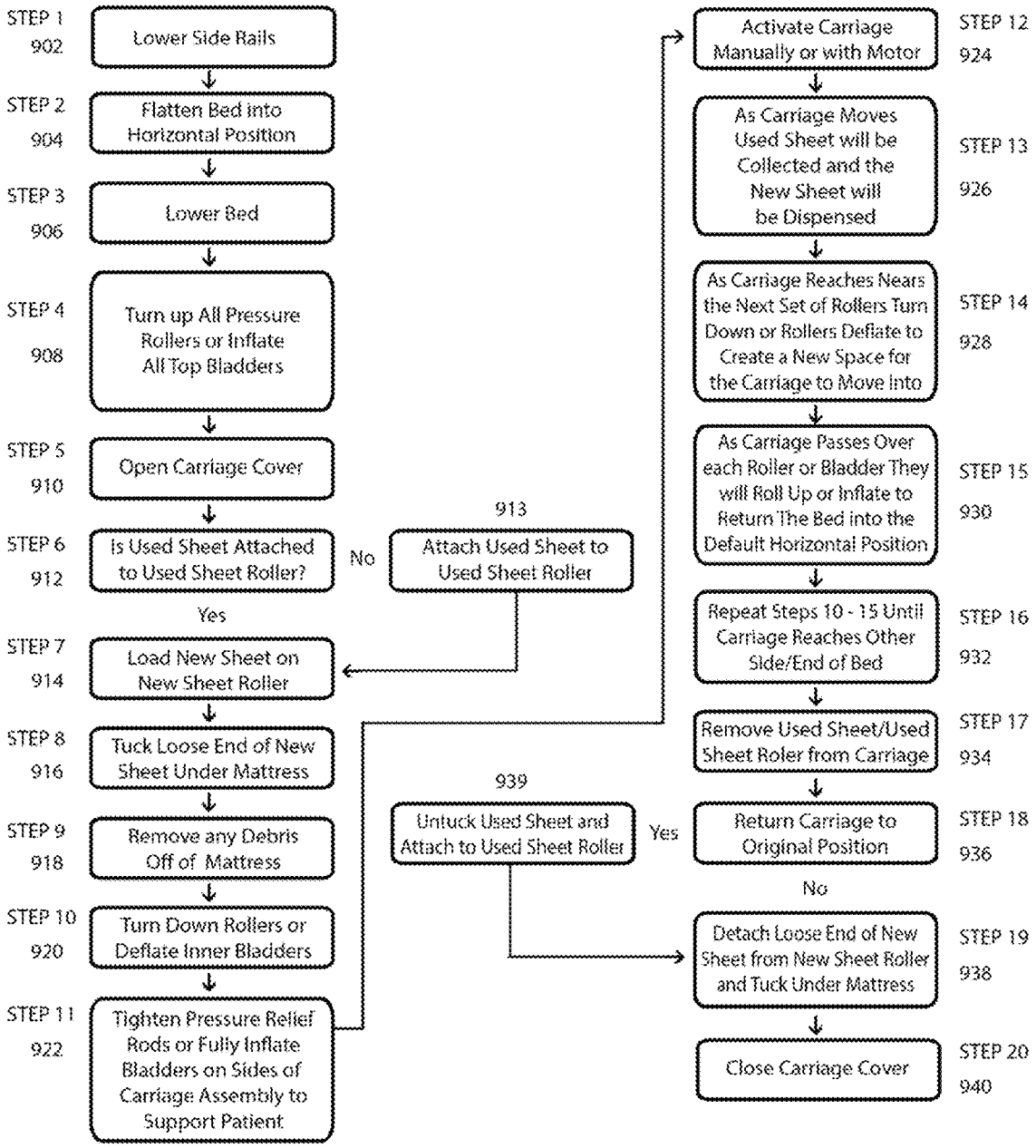
FIG. 11 is a block diagram explaining the sequence of operation for the entire bed including, but not limited to its ability to enable the bed frame assembly, carriage assembly and tension pulley assembly to function together in such a way as to facilitate the uninhibited movement of the carriage assembly across the bed to collect used bed sheets and dispense new bed sheets.

FIG. 11 is a block diagram explaining the sequence of operation for the entire bed, including, but not limited to its ability to enable the bed frame assembly, carriage assembly, and tension pulley assembly, to function together in such a way as to facilitate the uninhibited movement of the carriage assembly across the bed to collect used bed sheets, and dispense new bed sheets. In step 1, 902, one would lower side rails, and then in step 2, 904, one would flatten the bed into a horizontal position. In step 3, 906, the bed would be lowered, and in step 4, 908, one would tighten the bottom belts to raise primary mattress during this process the center of the mattress will be slightly higher than the sides of the mattress. In step 5, 910, one would open the carriage cover 265. In step 913, one would attach the used bed sheet onto the used bed sheet roller, and then in step 7, 914, one would load the new bed sheet onto the new bed sheet roller. In step 8, 916, one would tuck the loose end of the new bed sheet under the mattress. In step 9, 918, one would remove any debris off the mattress. In step 10, 920, one would loosen bottom belts under and the near the carriage. In step 11, 922, one would tighten top belts under or near the carriage. In step 12, 922, one would activate the carriage manually or using a motor. In step 13, 926, as the carriage moves the used bed sheets, and they will be collected and the new bed sheets will be dispensed onto the mattress. In step 14, 928, as the carriage moves and reaches near the next set of belts one would then tighten or loosen the belts to create new space or pocket 50, for the carriage to move into. In step 15, 930, as the carriage passes over each set of belts one would tighten or loosen the belts to return them to their original position. In step 16, 932, one would repeat step 10, 920, to step 15, 930, until the carriage reaches the other side or end of the bed. In step 17, 934, one would remove the used bed sheets from the used bed sheet roller from the carriage. In step 18, 936, one would return the carriage to the original position. In step 19, 938, one would detach the loose end of the new bed sheet from the new bed sheet roller and tuck it under the mattress. In step 939, one would untuck the used bed sheet from the used bed sheet roller and attach the used bed sheet roller back into the carriage. In step 20, 940, one would close the carriage cover 265.

A carriage assembly is used in conjunction with the pressure roller assembly to create space in which to move vertically and/or horizontally across the top of primary mattress in order to dispense and collect new and used bed sheets without disturbing the patient occupying the bed space and to apply pressure to mattress allowing said carriage assembly to move freely across the bed. Although the patient is not shown, it is understood that the space created by the carriage assembly in conjunction with the pressure roller assembly and/or air bladder assembly will enable the uninhibited movement of the carriage assembly under the patient to completed the bed sheet changing process as shown in the Figures, and more specifically in FIGS. 4, 9, and 10.

A pressure roller assembly is used in conjunction with the carriage assembly for maneuvering a series of pressure rollers to deform the primary mattress and secondary mattress frame in order to create space into which the carriage assembly can pass freely over the primary mattress to complete the bed sheet changing process and is also able to relieve pressure from the patient's neck, shoulder, buttocks and foot areas of the patient to reduce the likelihood of bedsores and/or other similar pressure related conditions and to facilitate patient healing. Although a patient is not shown, but it is understood that the space created by the maneuvering of the pressure rollers in conjunction with the downward pressure applied by the carriage assembly will function enable the uninhibited movement of the carriage assembly under the patient as well as being capable of removing pressure from underneath specific areas of the patient as specifically shown in the Figures, and more specifically in FIGS. 2A-2C, 5A-5B, 6A-6B, and 7A-7B.

An air bladder assembly is used in conjunction with the carriage assembly for relieving pressure from the primary mattress via a series of inflatable and deflatable air bladders to create enough space for the carriage assembly to fit in order to move from one side of the bed to the next side while completing the bed sheet changing process without tension and to relieve pressure from beneath the patient and provide an air exchange between the primary mattress and the patient in order to reduce the likelihood of bedsores, infections and/or other similar pressure related conditions, and also to facilitate patient healing and/or to reposition the patient as needed. Although the patient is not shown, it is understood that the space created by the deflation of the air bladders in conjunction with the downward pressure applied by the carriage assembly will enable the uninhibited movement of the carriage assembly under the patient to complete the bed sheet changing process as well as being capable of removing pressure from underneath specific areas of the patient as shown in the Figures, and more specifically as shown in FIGS. 8 and 9.

A hospital bed for seamlessly changing bed sheets while occupied by a patient, (a) a pressure roller assembly for deforming the primary mattress and secondary mattress frame in order to relieve pressure from the patient and/or creating space into which the carriage assembly to pass freely over it to complete the bed sheet changing process and to relieve pressure from the patient's neck, shoulder, buttocks and foot areas to reduce the likelihood of bedsores and/or other similar pressure related conditions and to facilitate patient healing, wherein said tension arc assembly comprises;

(a) a means in said pressure roller assembly for turning a timing belt;

(b) a means in said pressure roller assembly for turning the roller shafts;

(c) a means in said pressure roller assembly for engaging the roller shafts or slipping around them to prevent the rotation of the roller brackets;

(d) a means in said pressure roller assembly for holding and changing the pressure rollers;

(e) a means in said pressure roller assembly for connecting the roller brackets to the pressure rollers and allowing them to pivot thereon;

(d) a means in said pressure roller assembly for supporting the primary mattress and/or relieving pressure therefrom in order to deform it along with the patient's weight and or that of the carriage assembly; and (e) a means in said pressure roller assembly for connecting two pressure rollers together to allow part of the bed to be lifted without affecting the ability of the pressure roller assembly to support the primary mattress at various levels of compression.

A hospital bed for seamlessly changing bed sheets while occupied by a patient, comprising:

(a) a carriage assembly for moving vertically and/or horizontally across the top of the hospital bed in order to dispense and collect new and used bed sheets without disturbing the patient occupying the bed space and to apply pressure to mattress allowing said carriage assembly to move freely across the bed, wherein said carriage assembly comprises;

(b) a means in said carriage assembly for collecting the used bed sheets consisting of a removable rod that will rotate either counter clock-wise (ccw) or clock-wise (cw) depending on the motion of said carriage assembly;

(c) a means in said carriage assembly for dispensing the new bed sheet consisting of a removable rod that will rotate either counter clock-wise (ccw) or clock-wise (cw) depending on the motion of the carriage assembly;

(d) a means in said carriage assembly for applying downward pressure on top mattress and primary mattress to create clearance for the carriage assembly to freely move across the bed. Works in conjunction with the top belts;

(e) a means in said carriage assembly for providing the master rack gear with a means of moving the carriage assembly linearly along the bed frame. The carriage assembly contains a circular rack gear that rests on rack and enables the carriage to travel along the rack as the circular gear rotates, turning rotational motion into linear action;

(f) a means in said carriage assembly for holding the mounting plates on either end of the carriage assembly together;

(g) a means in said carriage assembly for rotating the used bed sheet roller when the master rack gear rotates, connected to said means for rolling up the used bed sheet;

(h) a means in said carriage assembly for rotating the new bed sheet roller when the master rack gear rotates, connected to said means for rolling up the new bed sheet;

(i) a means in said carriage assembly for guiding the carriage along to the gear rack via a threaded hole that interacts with threaded rod to reduce slippage, connected to said means for holding the headboard and the footboard together;

(j) a means in said carriage assembly for slipping and thereby preventing said roller from rotating when anything obstructs the rolling process dispensing and collecting the two said bed sheets, in order to protect the patient and bed components from being injured/damaged, connected to said means for rotating the new bed sheet roller when the master rack gear rotates, connected to said means for rotating the used bed sheet roller when the master rack gear rotates;

(k) a means in said carriage assembly for allowing the rotation of the various rollers, gears and pulleys used throughout the hospital bed;

(l) a means in said carriage assembly for engaging the gear rack in order to move the carriage assembly along the bed;

(m) a means in said carriage assembly for rotating the center belt in order to turn the master rack gear;

(n) a means in said carriage assembly for rotating the master gear when the center belt gear rotates;

(o) a means in said carriage assembly for rotating the threaded rod to move the carriage assembly across the bed;

(p) a means in said carriage assembly for holding both sides of carriage assembly together as well as preventing the patient from touching the rotating bed sheet rollers;

(q) a means in said carriage assembly for moving the carriage assembly along gear rack, connected to said means for rotating the threaded rod to move the carriage assembly across the bed;

(r) a means in said carriage assembly for holding all the different parts of the carriage assembly together;

(s) a means in said carriage assembly for providing additional comfort and protection for the patient, placed between top belts and patient body; and (t) a means in said carriage assembly for guiding the carriage along the threaded rod parallel to the gear rack, threadably inserted to said means for moving the carriage assembly along gear rack, and structurally embedded to said means for guiding the carriage along to the gear rack via a threaded hole that interacts with threaded rod to reduce slippage.

A hospital bed for seamlessly changing bed sheets while occupied by a patient, comprising:

(a) a programmable logic controller and/or microprocessor for determining the sequence of operation for the entire bed including, but not limited to its ability to enable the bed frame assembly, carriage assembly and pressure roller assembly to function together in such a way as to facilitate the uninhibited movement of the carriage assembly across the bed to collect used bed sheets and dispense new bed sheets. This is accomplished by elevating a section of the primary mattress via the pressure roller assembly, while simultaneously lowering another section thereof, creating an empty space large enough to allow the carriage assembly to pass freely over the primary mattress from one end of the bed to another without tension.

A hospital bed for seamlessly changing bed sheets while occupied by a patient, (a) an air bladder assembly for relieving pressure from the primary mattress via a series of inflatable and deflatable air bladders to create enough space for the carriage assembly to fit in order to move from one side of the bed to the next while completing the bed sheet changing process without tension and to relieve pressure from beneath the patient and provide an air exchange between the primary mattress and the patient to reduce the likelihood of bedsores, infections and/or other similar pressure related conditions, to facilitate patient healing and to reposition the patient as needed, wherein said air bladder assembly comprises;

(a) a means in said air bladder assembly for forming a deformable soft outer casing that supports the patient and contains the various bladders, valves and tubes of the air bladder assembly;

(b) a means in said air bladder assembly for creating an air exchange between the patient's body and the primary mattress in order maintain a dry, sterile environment under the patient which reduces the likelihood of bedsores, infections and/or other similar pressure related conditions and to facilitate patient healing and comfort and to deflate and lower sections of the primary mattress when downward pressure is applied to it and inflate and elevating sections of the primary mattress when pressure is removed from it;

(b) a means in said air bladder assembly for deflating and lowering sections of the primary mattress when downward pressure is applied to it and inflating and elevating sections of the primary mattress when pressure is removed from it;

(c) a means in said air bladder assembly for deflating and lowering sections of the primary mattress and inflating and elevating sections of the primary mattress such as the head/chest, the knee or foot areas, as desired by the patient or the caregiver;

(d) a means in said air bladder assembly for preventing air from escaping the various bladders during the bed sheet changing process, enable all the bladders which are not being compressed by the carriage assembly to maintain full bladder inflation and support the patient;

(e) a means in said air bladder assembly for enabling the free air exchange of the breathable top bladders to the patient;

(f) a means in said air bladder assembly for transferring air from the air supply to the various bladders throughout the mattress; and (g) a means in said air bladder assembly for inflating and deflating the various bladders placed throughout the primary mattress.

A hospital bed for seamlessly changing bed sheets while occupied by a patient, comprising:

(a) a carriage assembly for moving across the top of the hospital bed in order to dispense and collect new and used bed sheets without disturbing the patient occupying the bed space and to apply pressure to mattress allowing said carriage assembly to move freely across the bed, wherein said carriage assembly comprises;

(b) a means in said carriage assembly for collecting the used bed sheets consisting of a removable rod that will rotate either counter clock-wise (ccw) or clock-wise (cw) depending on the motion of said carriage assembly;

(c) a means in said carriage assembly for dispensing the new bed sheet consisting of a removable rod that will rotate either counter clock-wise (ccw) or clock-wise (cw) depending on the motion of the carriage assembly;

(d) a means in said carriage assembly for applying downward pressure on top mattress and primary mattress to create clearance for the carriage assembly to freely move across the bed. Works in conjunction with the top belts;

(e) a means in said carriage assembly for providing the master rack gear with a means of moving the carriage assembly linearly along the bed frame. The carriage assembly contains a circular rack gear that rests on rack and enables the carriage to travel along the rack as the circular gear rotates, turning rotational motion into linear action;

(f) a means in said carriage assembly for holding the mounting plates on either end of the carriage assembly together;

(g) a means in said carriage assembly for rotating the used bed sheet roller when the master rack gear rotates, connected to said means for rolling up the used bed sheet;

(h) a means in said carriage assembly for rotating the new bed sheet roller when the master rack gear rotates, connected to said means for rolling up the new bed sheet;

(i) a means in said carriage assembly for guiding the carriage along to the gear rack via a threaded hole that interacts with threaded rod to reduce slippage, connected to said means for holding the headboard and the footboard together;

(j) a means in said carriage assembly for slipping and thereby preventing said roller from rotating when anything obstructs the rolling process dispensing and collecting the two said bed sheets, in order to protect the patient and bed components from being injured/damaged, connected to said means for rotating the new bed sheet roller when the master rack gear rotates, connected to said means for rotating the used bed sheet roller when the master rack gear rotates;

(k) a means in said carriage assembly for allowing the rotation of the various rollers, gears and pulleys used throughout the hospital bed;

(l) a means in said carriage assembly for engaging the gear rack in order to move the carriage assembly along the bed;

(m) a means in said carriage assembly for rotating the center belt in order to turn the master rack gear;

(n) a means in said carriage assembly for rotating the master gear when the center belt gear rotates;

(o) a means in said carriage assembly for rotating the threaded rod to move the carriage assembly across the bed;

(p) a means in said carriage assembly for holding both sides of carriage assembly together as well as preventing the patient from touching the rotating bed sheet rollers;

(q) a means in said carriage assembly for moving the carriage assembly along gear rack, connected to said means for rotating the threaded rod to move the carriage assembly across the bed;

(r) a means in said carriage assembly for holding all the different parts of the carriage assembly together;

(s) a means in said carriage assembly for providing additional comfort and protection for the patient, placed between top belts and patient body; and (t) a means in said carriage assembly for guiding the carriage along the threaded rod parallel to the gear rack, threadably inserted to said means for moving the carriage assembly along gear rack, and structurally embedded to said means for guiding the carriage along to the gear rack via a threaded hole that interacts with threaded rod to reduce slippage.

A hospital bed for seamlessly changing bed sheets while occupied by a patient, comprising:

(a) a programmable logic controller and/or microprocessor for determining the sequence of operation for the entire bed including, but not limited to its ability to enable the carriage assembly and air bladder assembly to function together in such a way as to facilitate the uninhibited movement of the carriage assembly across the bed to collect used bed sheets and dispense new bed sheets. This is accomplished by elevating a section of the primary mattress via the air bladder assembly, while simultaneously lowering another section thereof, creating an empty space large enough to allow the carriage assembly to pass freely over the primary mattress from one end of the bed to another without tension.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A bed, comprising:

a mattress;

a carriage assembly comprising a carriage motor coupled to a gear assembly, wherein the motor and gear assembly are configured to move the carriage assembly across the mattress, and wherein the carriage assembly further comprises first and second sheet rollers coupled to the gear assembly, wherein the first sheet roller is configured to collect a used bed sheet from the mattress and the second sheet roller is configured to dispense a new bed sheet onto the mattress as the carriage assembly moves across the mattress from a first position to a second position; and adjacent means for reversibly lessening pressure underneath the carriage assembly so as to create a moving pocket in the mattress configured to allow the carriage assembly to move within the pocket from its first position to its second position.

2. The bed of claim 1, wherein the adjacent means are pressure roller assemblies, each comprising a roller shaft, a slip clutch, a roller bracket and a pressure roller.

3. The bed of claim 1, wherein the adjacent means are air bladder assemblies.

4. The bed of claim 3, wherein each air bladder assembly comprises a breathable top bladder, an outer bladder, an inner bladder, an adjustment bladder, a series of solenoid valves, air tubes and a pressurized air supply.

5. The bed of claim 4, wherein at least one of the air bladder assemblies is configured to allow regulation of an order and a speed of deflation of individual air bladders in the assembly.

* * * * *